US009375093B1

(12) United States Patent
Shin et al.

(10) Patent No.: US 9,375,093 B1
(45) Date of Patent: Jun. 28, 2016

(54) CHAIR WITH SELECTIVELY MUTABLE DECOR AND METHOD

(71) Applicant: Commercial Seating Products, Inc., South Hackensack, NJ (US)

(72) Inventors: Justin H. Shin, Upper Saddle River, NJ (US); Chonghak Kim, Lawrenceville, NJ (US)

(73) Assignee: Commercial Seating Products, Inc., South Hackensack, NJ (US)

( * ) Notice: Subject to any disclaimer, the term of this patent is extended or adjusted under 35 U.S.C. 154(b) by 315 days.

(21) Appl. No.: 14/075,219

(22) Filed: Nov. 8, 2013

(51) Int. Cl.
*A47C 7/72* (2006.01)
*A47C 7/02* (2006.01)

(52) U.S. Cl.
CPC .. *A47C 7/725* (2013.01); *A47C 7/02* (2013.01)

(58) Field of Classification Search
CPC . A47C 7/725; A47C 9/007; A47B 2220/0077
USPC ..... 297/217.6, 451.2, 451.3, 461, 462
See application file for complete search history.

(56) References Cited

U.S. PATENT DOCUMENTS 1,222,089 A * 4/1917 Ferry ..... G09F 23/00 297/183.8
3,756,169 A * 9/1973 Dybvig ..... A47B 7/00 108/150
4,929,021 A * 5/1990 Kaye ..... A47C 9/007 108/150
5,171,060 A 12/1992 Kaye
5,738,018 A 4/1998 Burnett
5,918,932 A * 7/1999 Morrison ..... A47B 97/00 108/23
6,595,654 B2 7/2003 Washburn
6,672,552 B1 * 1/2004 Jao ..... A46B 15/0087 248/251
6,854,869 B1 2/2005 Fernandez
7,303,304 B2 12/2007 Gharabegian
7,559,667 B2 7/2009 Holderman
8,113,678 B2 * 2/2012 Babcock ..... A47B 47/0083 108/107
8,388,188 B2 3/2013 Propp
8,522,494 B2 9/2013 Ward
2006/0087165 A1 4/2006 Gharabegian
2006/0256550 A1 11/2006 Schultz
2007/0253214 A1 11/2007 Kaiser
2010/0314916 A1 12/2010 Walser
2012/0204346 A1 8/2012 Billauer
2013/0147244 A1 * 6/2013 Carter, III ..... A47C 13/005 297/217.6

* cited by examiner

*Primary Examiner* — Sarah McPartlin
(74) *Attorney, Agent, or Firm* — Arthur Jacob

(57) ABSTRACT

A chair has a selectively mutable decor, readily changed selectively by providing at least one of the component parts of the chair with a transparent wall surrounding an inner chamber for receiving any one of a plurality of decorative components through an access to the inner chamber. The access preferably is closed with a closure, the closure being removable to open access to the inner chamber for insertion of a selected decorative component, and being secured to capture the inserted decorative component within the inner chamber for viewing through the surrounding wall. A wide variety of decorative components is available, enabling the decor of the chair to be changed to accommodate the requirements of the venue within which the chair is to be placed.

17 Claims, 5 Drawing Sheets

CHAIR WITH SELECTIVELY MUTABLE DECOR AND METHOD

The present invention relates generally to chairs and pertains, more specifically, to a chair construction having a selectively mutable decor such as, for example, an event chair selectively decorated to coordinate with a particular event where the chair is placed into use, and a method for changing the decor of the chair.

Chairs are ubiquitous and are so taken for granted in so many settings that chairs often go essentially unnoticed. While an almost infinite number of external chair designs have been proposed, and many implemented, very little attention has been given to offering a choice of a particular design in alternate decor options, other than by merely offering a particular external design in any one of a plurality of chairs, each having an alternate, fixed decor.

For example, the conduct of a particular event very often will generate a requirement for a large number of event chairs, usually of uniform appearance, which requirement often is filled by arranging, through a rental organization, for the temporary use by the event operator of these event chairs. Since it is impractical for the rental organization to stock large numbers of event chairs of alternate decor, the choice available for the particular event is severely limited.

The present invention provides a chair having a selectively mutable decor, and a method for changing the decor of the chair, so that the rental organization is able to change the decor of the available event chairs to suit the requirements of a particular event, without requiring an increased inventory of the event chairs themselves. As such, the present invention attains several objects and advantages, some of which are summarized as follows: Provides a chair construction in which at least one component of the chair includes a selectively accessible chamber for the reception of one or more decorative elements viewable through the wall of the component to furnish the chair with a particular selected decor; enables a chair to be decorated, selectively, so as to present a particular decor that can be changed to accommodate the requirements of a specific event or venue served by the chair; facilitates a change in decor of a chair for increased versatility in serving at a greater variety of functions; allows the maintaining of a limited inventory of chairs capable of displaying a decor selected from a variety of optional alternatives for meeting the requirements of a particular venue; provides a single chair capable of being decorated selectively to display any one of a wide variety of available decorative effects; provides a chair with a high degree of structural integrity while enabling the display of a selected one of a wide variety of decorative effects; enhances the appearance of a chair by incorporating a selected decorative effect from a plurality of interchangeable decorative effects; enables a selective change in the decor of a chair, without affecting the structural integrity of the chair; allows exceptional ease and versatility in effecting a selected change in the appearance of a chair; provides a chair with a selectively mutable decor in a construction that exhibits exemplary performance over an extended service life.

The above objects and advantages, as well as further objects and advantages, are attained by the present invention which may be described briefly as a chair having a selectively mutable decor, the chair comprising: a chair seat; a chair back extending upwardly from the chair seat, the chair back including laterally opposite, spaced apart uprights, each having a vertically lowermost end, and a vertically opposite uppermost terminal end; at least one of the uprights having a wall surrounding an inner chamber extending between the terminal end and the lowermost end, the surrounding wall being constructed of a material having light-transmitting characteristics; and a closure selectively attached and secured to the one of the uprights to close the inner chamber, and selectively detached from the one of the uprights to remove the closure and provide access to the inner chamber; whereby upon selective removal of the closure from the one of the uprights, the inner chamber is open for the reception and insertion of any selected one of a plurality of decorative components, and upon attachment and securement of the closure to the one of the uprights, an inserted decorative component is captured within the inner chamber for viewing through the surrounding wall.

In addition, the present invention provides a chair having a selectively mutable decor, the chair comprising: a chair seat; chair legs extending from the chair seat for supporting the chair seat; at least one of the chair legs having a wall surrounding an inner chamber, the surrounding wall being constructed of a material having light-transmitting characteristics; and a closure selectively attached and secured to the one of the chair legs to close the inner chamber, and selectively detached from the one of the chair legs to remove the closure and provide access to the inner chamber; whereby upon selective removal of the closure from the one of the chair legs, the inner chamber is open for the reception and insertion of any selected one of a plurality of decorative components, and upon attachment and securement of the closure to the one of the chair legs, an inserted decorative component is captured within the inner chamber for viewing through the surrounding wall.

Further, the present invention includes a method for selectively changing the decor of a chair having a chair seat, chair legs extending from the chair seat for supporting the chair seat, and a chair back extending upwardly from the chair seat, the chair back including laterally opposite, spaced apart uprights, each having a vertically lowermost end, and a vertically opposite uppermost terminal end, the method comprising: providing at least one of the chair legs and the uprights with a wall surrounding an inner chamber; constructing the surrounding wall of a material having light-transmitting characteristics; providing an access to the inner chamber; selecting one of the plurality of decorative components; and inserting into the inner chamber, through the access, the selected one of the decorative components.

The invention will be understood more fully, while still further objects and advantages will become apparent, in the following detailed description of preferred embodiments of the invention illustrated in the accompanying drawing, in which.

Figure 1:
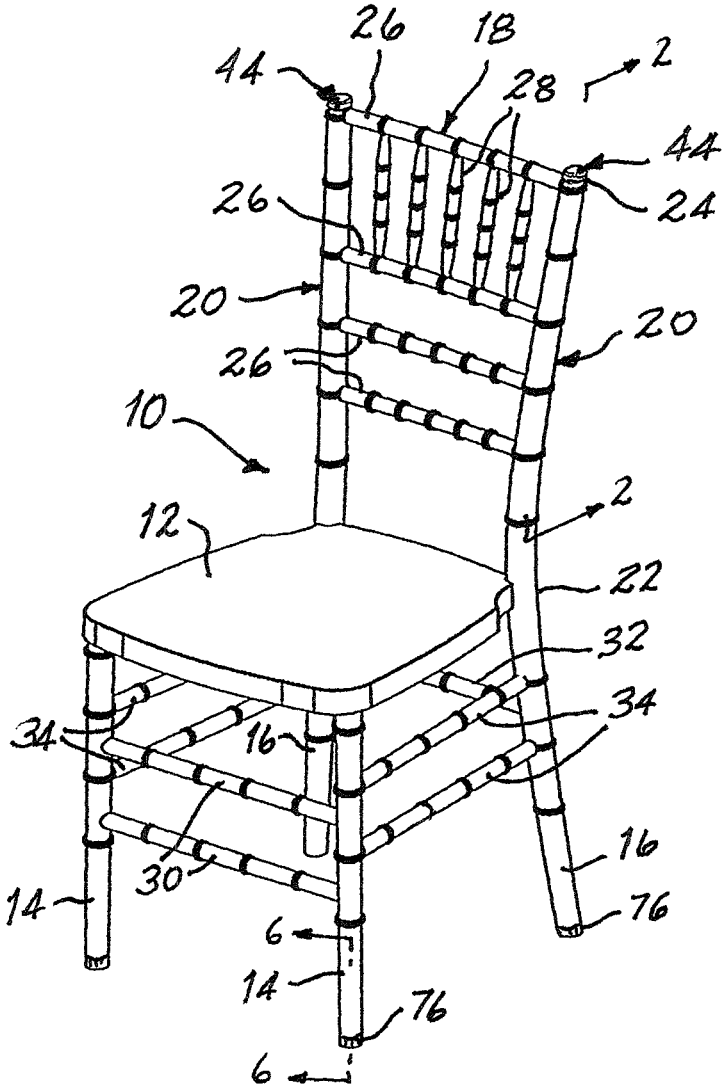
FIG. 1 is a pictorial perspective view of a chair constructed in accordance with the present invention.

Referring now to the drawing, and especially to FIG. 1 thereof, a chair constructed in accordance with the present invention is shown at 10 and is seen to include a seat 12, a pair of front legs 14, a pair of rear legs 16 and a chair back 18. Chair 10 is constructed of a molded synthetic polymeric material, preferably a polycarbonate that provides a high degree of structural integrity and strength. Chair back 18 preferably is molded integrally with rear legs 16, extends vertically upwardly from rear legs 16, and includes opposite uprights 20 spaced apart laterally, each upright 20 extending vertically upwardly from a lowermost end 22 integral with a corresponding leg 16 to an uppermost terminal end 24 spaced vertically away from corresponding leg 16. Uprights 20 are joined by horizontal spindles 26, two of which are joined by vertical spindles 28 to complete the chair back 18. Front braces 30 join together the front legs 14, while a rear brace 32 extends between the rear legs 16, and side braces 34 join together corresponding front and rear legs 14 and 16 to complete a rigid construction of exceptional structural integrity.

Chair 10 is an event chair, that is, chair 10 is in the form of a "Chiavari" style chair, currently popular for use at a wide variety of events. It has become common among managers of events that require a large number of event chairs, to obtain the necessary number of chairs through a rental organization, thereby avoiding the necessity for maintaining a large inventory of chairs. The chairs available through a rental organization usually are of a standard decor, usually comprised of a standard color, since it is not economical for a rental organization to maintain a large inventory of chairs of different decor. Thus, the choices available to the event manager are limited.

The present invention provides practical means for enlarging the choices available in the decor of a chair, without the necessity for a concomitant enlargement of the number of chairs maintained in an inventory. Thus, the present invention enables a single chair to be decorated with a selected decor, thereby increasing the versatility of the chair and eliminating the requirement for a large inventory of chairs. Accordingly, the present invention provides a chair constructed with a selectively mutable decor, as demonstrated by the construction of the illustrated embodiment in the form of chair 10.

Figure 2:
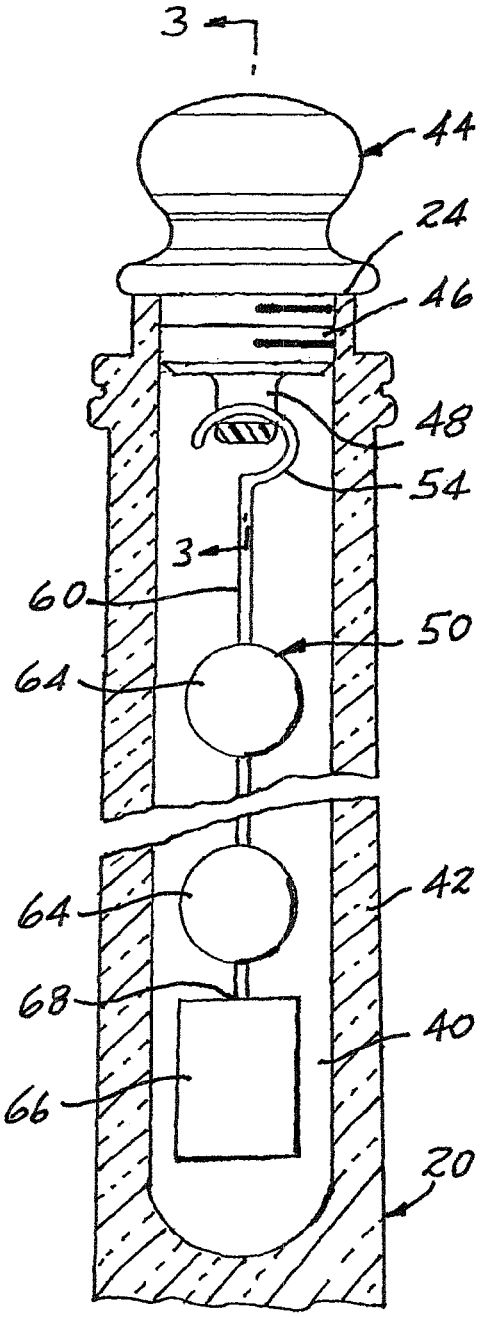
FIG. 2 is an enlarged fragmentary cross-sectional view taken along line 2-2 of FIG. 1.
Figure 3:
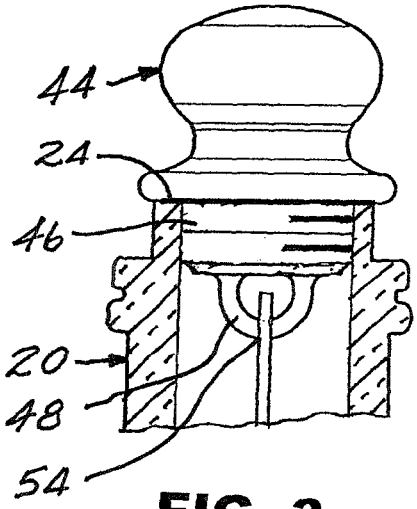
FIG. 3 is a fragmentary cross-sectional view taken along line 3-3 of FIG. 2.
Figure 4:
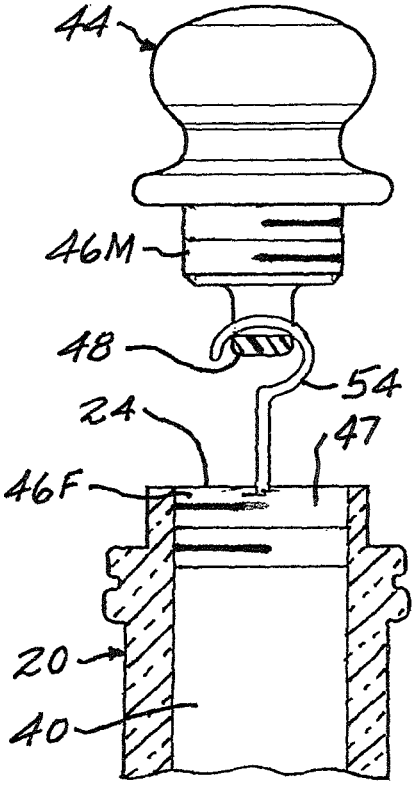
FIG. 4 is an exploded fragmentary cross-sectional view ofthe component parts shown in FIG. 2.

Referring now to FIGS. 2 through 4, as well as to FIG. 1, each upright 20 is constructed of a material that has light-transmitting characteristics, the preferred material being an intrinsically transparent polycarbonate, molded in a tubular configuration so as to include an inner chamber 40 surrounded by a transparent wall 42. At the uppermost terminal end 24, a closure, shown in the form of a cap 44, is received within the upright 20, as seen in FIGS. 2 and 3, and is secured in place by a threaded connection 46 that includes a male thread 46M and a complementary female thread 46F, enabling selective release of the cap 44 from the upright 20, as illustrated in FIG. 4, thereby providing an access at 47 to inner chamber 40. Cap 44 preferably also is constructed of a light-transmitting material.

Figure 5:
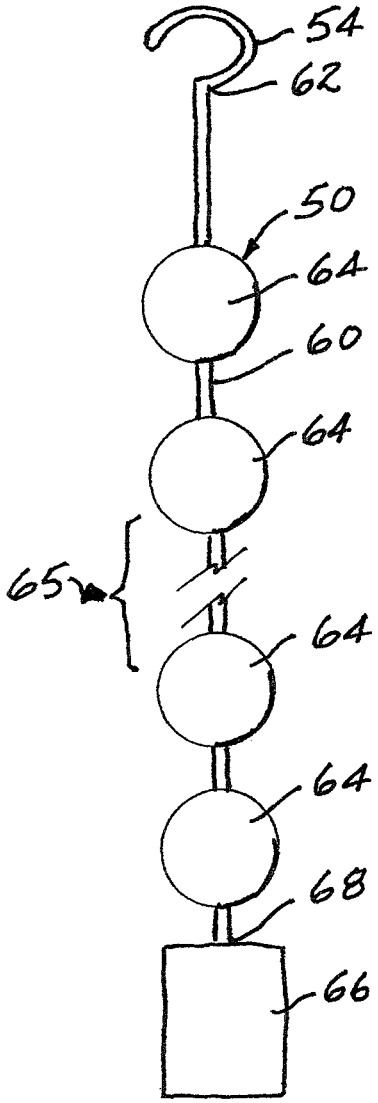
FIG. 5 is a side elevational view of a decorative component illustrated in FIGS. 2 through 4.

Cap 44 carries an integral loop 48, and a decorative component 50 is coupled with the cap 44 by means of a hook 54 passed through the loop 48 to suspend the decorative component 50 from the cap 44, the hook 54 and the loop 48 thus together comprising a coupler. As best seen in FIG. 5, decorative component 50 includes an elongate shaft 60, and hook 54 extends from shaft 60, at the top end 62 of shaft 60. Shaft 60 carries a plurality of decorative members, shown in the form of light-emitting-diodes (LEDs) 64 spaced apart longitudinally along shaft 60 in a vertical array 65. A battery pack 66 is placed at the bottom end 68 of the shaft 60 and is connected to the LEDs 64 to power the LEDs 64. At the same time, the battery pack 66 serves as a weight to facilitate insertion of the decorative component 50 into inner chamber 40 and maintain the decorative component 50 deployed throughout inner chamber 40. A decorative component 50 is lowered into each upright 20, with the shaft 60 of each decorative component 50 lowered into the inner chamber 40 of a corresponding upright 20, and a cap 44 secured in each upright 20, such that a decorative component 50 is in place within each upright 20, and chair back 18 is decorated with decorative members, in the form of LEDs 64, placed within each inner chamber 40 in vertical array 65 and viewed through each surrounding wall 42.

Figure 6:
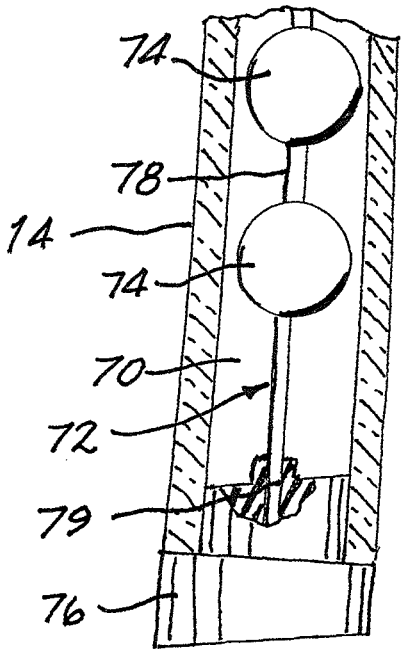
FIG. 6 is an enlarged fragmentary cross-sectional view taken along line 6-6 of FIG. 1.

In a similar manner, one or more of the front legs 14 and the rear legs 16 may be constructed with a corresponding inner chamber 70, as illustrated FIG. 6, in connection with the construction of a front leg 14, and a decorative component 72, comprised of a string of decorative members, shown in the form of LEDs 74, may be inserted into a corresponding inner chamber 70, maintained in place by a selectively removable basal plug 76 constructed of a resilient material which frictionally engages leg 14 to secure basal plug 76 in place and which enables ready removal of basal plug 76 for selective access to chamber 70. Shaft 78 is coupled with basal plug 76 by means of a frictional connection at 79 and has a stiffness sufficient to maintain LEDs 74 arrayed vertically along front leg 14.

Figure 7:
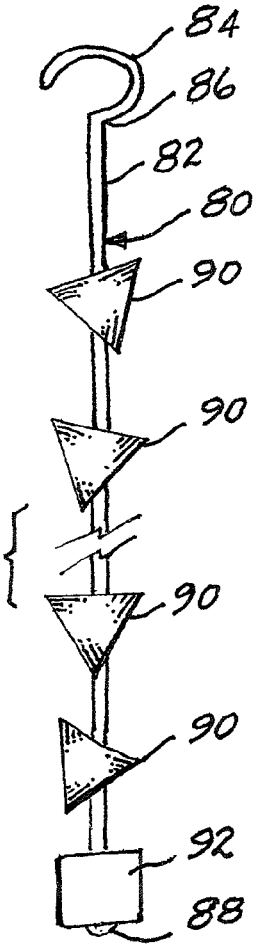
FIG. 7 is a side elevational view of an alternate decorative component.
Figure 8:
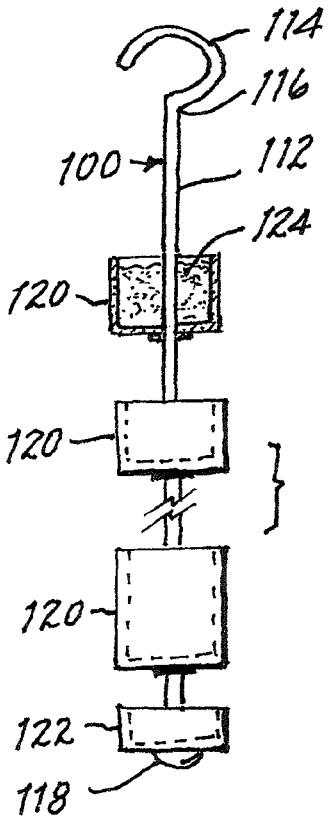
FIG. 8 is a side elevational view of another alternate decorative component.
Figure 9:
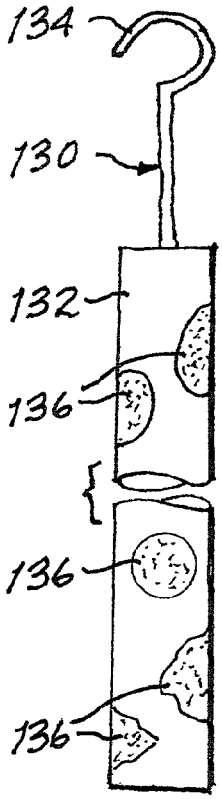
FIG. 9 is a side elevational view of still another alternate decorative component.
Figure 10:
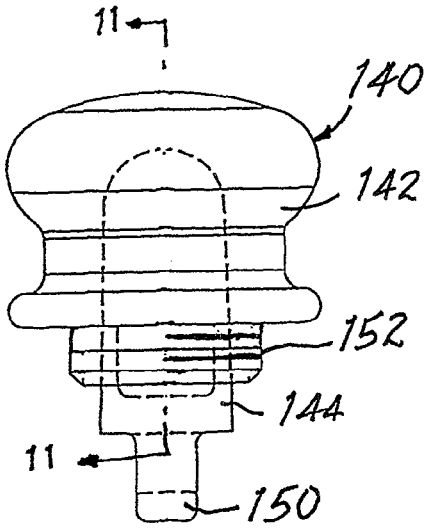
FIG. 10 is a side elevational view of an alternate embodiment of a component part.
Figure 11:
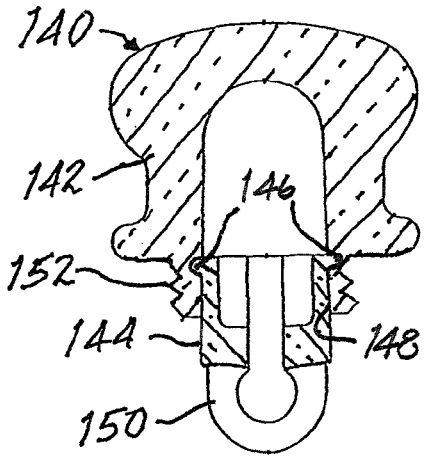
FIG. 11 is a cross-sectional view taken along line 11-11 of FIG. 10.
Figure 12:
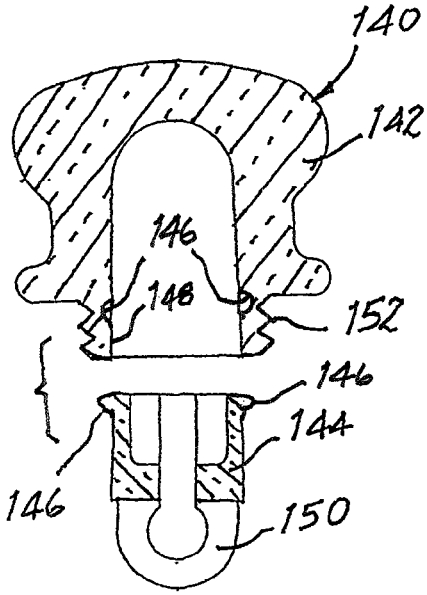
FIG. 12 is an exploded cross-sectional view of the component part of the embodiment of FIG. 10.

A wide variety of alternate decorative components can be made available so as to accommodate the needs of a particular venue, without the necessity for enlarging an inventory of chairs 10. Some such alternate decorative components are illustrated in FIGS. 7 through 9. With reference to FIG. 7, a decorative component 80 is constructed similar to decorative component 50 in that a shaft 82 extends from a hook 84 at a top end 86 to a bottom end 88. A plurality of decorative members comprise light reflective elements, shown in the form of chips 90, strung along the shaft 82, with a weight 92 placed at the bottom end 88 so that the chips 90 are spread out and effect an aesthetically pleasing display, viewable through the wall 42 of an upright 20, when in place in the upright 20. Hook 84 allows a simple connection to loop 48 of cap 44, facilitating replacement of decorative component 50 with decorative component 80, for a selective change in the decor of chair 10.

With reference to FIG. 8, another alternate decorative component 100 is constructed similar to decorative component 50 in that a shaft 112 extends from a hook 114 at a top end 116 to a bottom end 118. A plurality of decorative members are here in the form of transparent cups 120, strung along the shaft 112, with a weighted cup 122 placed at the bottom end 118 so that the cups 120 are spread out in a vertical array along the shaft 112. A variety of aesthetically pleasing displays, viewable through the wall 42 of an upright 20, is provided when decorative component 100 is in place in the upright 20, by placing any one of a variety of items within the cups 120. For example, the cups 120 may be filled with a colored liquid, or with a colored particulate material, such as sand, as seen at 124, or with beads and the like. Hook 114 allows a simple connection to loop 48 of cap 44, facilitating replacement of decorative component 50 with decorative component 100, for a selective change in the decor of chair 10.

Turning now to FIG. 9, still another alternate decorative component 130 is shown having a cylindrical member 132 suspended from a hook 134. Cylindrical member 132 is provided with visual items, shown in the form of graphic or photographic elements 136 placed along the cylindrical member 132 such that the elements 136 are viewable through the surrounding wall 42 of an upright 20, when decorative component 130 is in place in the upright 20. The hook 134 allows a quick and easy connection to loop 48 of cap 44 when decorative component 130 replaces decorative component 50.

Turning now to FIGS. 10 through 13, an alternate closure construction is illustrated in the form of a cap 140 which can serve in place of cap 44. Cap 140 includes a crown member 142 and a tubular member 144, both of which are constructed of light-transmitting material. Tubular member 144 is fitted into and secured, as by a friction fit or by detent elements 146, in a recess 148 in crown member 142, thereby rendering cap 140 in the form of an integrated assembly. A loop 150 depends from tubular member 144 for purposes of coupling to cap 140 a decorative component, in the manner described above in connection with the coupling of any one of a number of decorative components with cap 44. A male thread 152 on cap 140 is complementary to female thread 46F in upright 20, so that cap 140 is readily interchangeable with cap 44.

Figure 13:
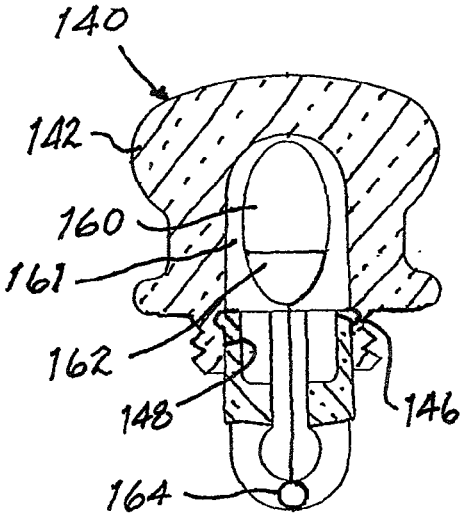
FIG. 13 is a cross-sectional view similar to FIG. 11, and showing an optional construction of the embodiment of FIG. 10.

As seen in FIG. 13, a light source 160, preferably in the form of an LED, may be placed within crown 142 of cap 140, in an inner cavity 161 extending above recess 148, for illuminating cap 140 to provide an additional aesthetic decorative effect. Light source 160 may be powered by a self-contained battery 162 or, when loop 150 is coupled with a decorative component, such as decorative component 50, an electrical connection may be made at 164 to a source of power outside of cap 140, such as the battery pack 66.

It will be seen that the present invention attains all of the objects and advantages summarized above, namely: Provides a chair construction in which at least one component of the chair includes a selectively accessible chamber for the reception of one or more decorative elements viewable through the wall of the component to furnish the chair with a particular selected decor; enables a chair to be decorated, selectively, so as to present a particular decor that can be changed to accommodate the requirements of a specific event or venue served by the chair; facilitates a change in decor of a chair for increased versatility in serving at a greater variety of functions; allows the maintaining of a limited inventory of chairs capable of displaying a decor selected from a variety of optional alternatives for meeting the requirements of a particular venue; provides a single chair capable of being decorated selectively to display any one of a wide variety of available decorative effects; provides a chair with a high degree of structural integrity while enabling the display of a selected one of a wide variety of decorative effects; enhances the appearance of a chair by incorporating a selected decorative effect from a plurality of interchangeable decorative effects; enables a selective change in the decor of a chair, without affecting the structural integrity of the chair; allows exceptional ease and versatility in effecting a selected change in the appearance of a chair; provides a chair with a selectively mutable decor in a construction that exhibits exemplary performance over an extended service life.

It is to be understood that the above detailed description of preferred embodiments of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A chair having a selectively mutable decor, the chair comprising:

a chair seat;

a chair back extending upwardly from the chair seat, the chair back including laterally opposite, spaced apart uprights, each having a vertically lowermost end, and a vertically opposite uppermost terminal end;

at least one of the uprights having a wall surrounding an inner chamber extending between the terminal end and the lowermost end, the surrounding wall being constructed of a material having light-transmitting characteristics; and a closure selectively attached and secured to the one of the uprights to close the inner chamber, and selectively detached from the one of the uprights to remove the closure and provide access to the inner chamber;

whereby upon selective removal of the closure from the one of the uprights, the inner chamber is open for the reception and insertion of any selected one of a plurality of decorative components, and upon attachment and securement of the closure to the one of the uprights, an inserted decorative component is captured within the inner chamber for viewing through the surrounding wall.

2. The chair of claim 1 wherein the material of the surrounding wall comprises an intrinsically transparent synthetic polymeric material.

3. The chair of claim 1 wherein the inner chamber extends from the terminal end of the one of the uprights toward the lowermost end of the one of the uprights, the closure is selectively attached and secured to the one of the uprights at the terminal end, and the closure comprises a cap including a coupler for coupling the selected one of the plurality of decorative components to the cap, with the selected one decorative component suspended from the cap, to facilitate insertion of the decorative component into the inner chamber and selective removal of the decorative component from the inner chamber.

4. The chair of claim 3 wherein the cap is constructed of a material having light-transmitting characteristics.

5. The chair of claim 4 wherein the cap includes an inner cavity, and a light source placed within the inner cavity.

6. The chair of claim 3 wherein the selected one of the decorative components comprises a plurality of light sources spaced apart longitudinally along a vertical array for extending within the inner chamber, between the lowermost end and the terminal end of the one of the uprights, and viewable through the surrounding wall.

7. The chair of claim 6 wherein the light sources comprise LEDs.

8. The chair of claim 3 wherein the selected one of the decorative components comprises a plurality of light reflective elements spaced apart longitudinally along a vertical array for extending within the inner chamber, between the lowermost end and the tenninal end of the one of the uprights, and viewable through the surrounding wall.

9. The chair of claim 3 wherein the selected one of the decorative components comprises a plurality of transparent cups spaced apart longitudinally along a vertical array for extending within the inner chamber, between the lowermost end and the terminal end of the one of the uprights, and viewable through the surrounding wall.

10. The chair of claim 3 wherein the selected one of the decorative components comprises a cylindrical member having visual items spaced apart longitudinally along a vertical array for extending within the inner chamber, between the lowermost end and the terminal end of the one of the uprights, and viewable through the surrounding wall.

11. The chair of claim 1 wherein each of the uprights has a wall surrounding a corresponding inner chamber extending between the terminal end and the lowermost end, each surrounding wall being constructed of a material having light-transmitting characteristics;

a closure selectively attached and secured to each of the uprights to close the corresponding inner chamber, and selectively detached from each of the uprights to remove a corresponding closure and provide access to the corresponding inner chamber;

whereby upon selective removal of a corresponding closure from either one of the uprights, the corresponding inner chamber is open for the reception and insertion of any selected one of a plurality of decorative components, and upon attachment and securement of a corresponding closure to either one of the uprights, an inserted decorative component is captured within the corresponding inner chamber for viewing through a corresponding surrounding wall.

12. The chair of claim 11 wherein each inner chamber extends from the terminal end of a corresponding upright toward the lowermost end of the corresponding upright, and each closure comprises a cap including a coupler for coupling a selected one of the plurality of decorative components to the cap, with the selected one decorative component suspended from the cap, to facilitate insertion of the decorative component into a corresponding inner chamber and selective removal of the decorative component from the corresponding inner chamber.

13. The chair of claim 12 wherein the material of each surrounding wall comprises an intrinsically transparent synthetic polymeric material.

14. The chair of claim 12 wherein each cap is constructed of a material having light-transmitting characteristics.

15. The chair of claim 14 wherein each cap includes an inner cavity, and a light source placed within the inner cavity.

16. The chair of claim 1 including:

chair legs extending from the chair seat for supporting the chair seat;

at least one of the chair legs having a further wall surrounding a further inner chamber, the surrounding further wall being constructed of a material having light-transmitting characteristics; and a further closure selectively attached and secured to the one of the chair legs to close the further inner chamber, and selectively detached from the one of the chair legs to remove the further closure and provide access to the further inner chamber;

whereby upon selective removal of the further closure from the one of the chair legs, the further inner chamber is open for the reception and insertion of any selected one of a plurality of further decorative components, and upon attachment and securement of the further closure to the one of the chair legs, an inserted further decorative component is captured within the further inner chamber for viewing through the surrounding further wall.

17. The chair of claim 16 wherein the material of the surrounding further wall comprises an intrinsically transparent synthetic polymeric material.

* * * * *